US006196470B1

(12) United States Patent
Neumann

(10) Patent No.: US 6,196,470 B1
(45) Date of Patent: Mar. 6, 2001

(54) COVERING LEVEL WITH RAILS FOR RAILWAY TRACKS

(75) Inventor: Bernhard Neumann, Gmunden (AT)

(73) Assignee: Gmundner Fertigteile Gesellschaft m.b.H. & Co. KG, Gmunden (AT)

( * ) Notice: Subject to any disclaimer, the term of this patent is extended or adjusted under 35 U.S.C. 154(b) by 0 days.

(21) Appl. No.: 09/202,307

(22) PCT Filed: Jun. 11, 1997

(86) PCT No.: PCT/AT97/00122

§ 371 Date: Dec. 11, 1998

§ 102(e) Date: Dec. 11, 1998

(87) PCT Pub. No.: WO97/47816

PCT Pub. Date: Dec. 18, 1997

(30) Foreign Application Priority Data

Jun. 11, 1996 (AT) ..... 1015/96

(51) Int. Cl.[7] ..... E01B 26/00

(52) U.S. Cl. ..... 238/8

(58) Field of Search ..... 238/2, 3, 5, 4, 238/8; 52/578, 586.1, 589.1, 590.1, 590.2, 591.1, 591.2, 592.1; 404/18, 34, 40, 41, 47, 50, 51, 53, 56

(56) References Cited

U.S. PATENT DOCUMENTS 1,916,620 * 7/1933 Johnson ..... 52/589.1
2,839,249 * 6/1958 Curtis ..... 238/8
4,093,120 * 6/1978 Canfield ..... 238/8
6,006,486 * 12/1999 Moriau et al. ..... 404/50

FOREIGN PATENT DOCUMENTS 634 367-A5 6/1978 (CH) .
23 50 759 4/1975 (DE) .
23 60 759 4/1975 (DE) .
77 11 191 9/1978 (DE) .
9 400 910 1/1996 (NL) .
195304 11/1992 (TW) .

* cited by examiner

*Primary Examiner*—Mark T. Le
(74) *Attorney, Agent, or Firm*—Sughrue, Mion, Zinn, Macpeak & Seas, PLLC

(57) ABSTRACT

A level cover for tracks (1), wherein the space (4) present between the two rails of a track is bridged by slabs (5, 6) arranged in pairs, which slabs are merely supported on the rails (2, 3) and bridge the distance (13) between the rails self-supportingly, the two slabs of the slab pairs being assembled in hinge-like manner. At their facing rims (15, 16), the slabs (5, 6) of each slab pair have carrying portions (17) and resting portions (18) alternatingly following each other in meander-like fashion, the carrying portions being formed by indentations (20) originating from the slab upper side (19) and extending as far as to the rim facing the other slab, upwardly directed indentations (22) originating from the slab lower side (21) being formed below the resting portions (18), which indentations are shaped complementary to the indentations of the carrying portions. The resting portions of the one slab rest on the carrying portions of the other slab, and the resting portions of the other slab rest on the carrying portions of the one slab. The slabs for the level cover are preferably made of concrete and provided with a reinforcement.

11 Claims, 4 Drawing Sheets

COVERING LEVEL WITH RAILS FOR RAILWAY TRACKS

BACKGROUND OF THE INVENTION

The invention relates to a level cover for tracks, wherein the space present between the two rails of a track is filled or bridged by slabs arranged in pairs which engage by at least one rim ledge in the fishing surfaces of the rails and are merely supported on the rails, bridging the distance between the rails self-supportingly, the two slabs of the slab pairs being assembled in hinge-like manner.

Level covers for rails are provided to allow road vehicles to drive over track regions. A particularly important field of use is in level railway crossings, i.e. intersections between roadways and railway lines. There, the mounting of the constructional elements forming the roadway in the track region is of great importance, since vehicles passing the crossing, particularly the rail vehicles, exert considerable static and dynamic loads on the traffic paths. In the region of a level crossing, the elastic properties of the track, which to a great extent are determined by the rail bedding, should possibly not at all or only slightly differ from the respective properties demanded of the track portions following upon such a crossing. This appears feasible if the properties of the rail bedding are not changed by constructional elements of the roadway that directly rest on the bedding elements.

Thus, with level rail covers, one has arrived at types of construction in which the space present between the two rails of a track is bridged by slabs which engage in the fishing surfaces of the rails and are merely supported on the rails, bridging the distance between the rails self-supportingly. In this respect there exist types of construction in which single slabs each are supported on the two rails of a track by their oppositely arranged rims, elastic sections being arranged between the rims of such a slab and the fishing surfaces of the rails. Insertion of such slabs does comprise certain difficulties and requires experienced workers, and, as a rule, it is necessary to insert two angular elastic sections at least on one rim side of these slabs to them on the fishing surfaces of the rail, one of these angular sections being placed at the rail base and the other one below the rail head. One way of enabling a simple insertion of slabs which are to bridge the space present between the two rails of a track in a level cover for tracks and are to be supported merely on the rails consists in the use of slab pairs whose two slabs are assembled in hinge-like manner, the hinge axis extending in the longitudinal direction of the track. In a known level cover of this type (DE-23 50 759-A2) the insertion of this slab pair between the two rails of a track can be effected in a relatively simple manner by folding up the slab pair, yet on account of the design used there of the hinge-like connection in the form of a hinge rod inserted between the two slabs of the slab pair, on which hinge rod the slabs simply abut, strong lateral forces which attempt to press the rails apart are exerted by the slabs on the rails, if heavier loads act on the slab pair, which doubtlessly is detrimental; there is also the risk that the stability limit will be overcome and the slabs will swing through downwardly until the hinge zone will come to lie on the sleepers of the track.

SUMMARY OF THE INVENTION

It is an object of the present invention to provide a level cover of the initially defined type, in which the disadvantages of known designs are avoided and detrimental static and dynamic influences on the track and its bedding will be eliminated to the greatest extent, and wherein also the installation and removal of the slabs to be provided between the two rails of a track can be effected in a simple manner.

The level cover according to the invention of the initially mentioned type is characterized in that the slabs of each slab pair rest on each other at their facing rims, and carrying portions and resting portions alternatingly following each other in meander-like fashion are provided at each slab along the rim facing the other slab, the carrying portions being formed by indentations originating from the slab upper side and extending as far as to the rim facing the other slab, upwardly directed indentations originating from the slab lower side being formed below the resting portions, which indentations are shaped complementary to the indentations of the carrying portions, and that the resting portions of the one slab rest on the carrying portions of the other slab, and the resting portions of the other slab rest on the carrying portions of the one slab. By this design, the aforementioned object can be met well in a structurally simple manner. The hinge-like assembled zones of the slabs of each slab pair may simply be put toghether with the slabs being folded up, whereupon the slabs may be inserted between the rails without any problems, with the slab pair being levelled, and even if heavy loads act on the slabs, such as, e.g., occur when heavy trucks roll over them, the slabs will not be pressed apart.

A preferred embodiment which is characterized in that at those surfaces, on which the slabs of one slab pair contact each other, projections and indentations shaped complementary to the projections are formed, the projections latchingly engaging in the indentations for a mutual latching of the slabs, has the advantage that the positive fit of the slabs of one slab pair will be ensured over very long periods of time even if unfavorable vibrations act on the slabs.

For as simple as possible an insertion procedure of the slabs between the rails with little expenditure of force, and for enabling a simple removal of the slabs it is advantageous if the carrying surfaces provided in the carrying portions, originating from the rim facing the other slab of the slab pair, at first rise steeply, starting from the slab lower side, and then flatten. There, it is furthermore suitable and also advantageous for ensuring a stable positive fit of the slabs in their installed state over extended periods of time if the carrying surfaces provided in the carrying portions have a crowned shape, which shape inhibits a mutual movement of these slabs in the direction of the slab plane in the levelled position of the slabs of the respective slab pair. Such a crowned shape may be formed on a slab by a surface portion originating from the rim facing the other slab of the slab pair, which surface portion extends away from the lower side of the slab, and a consecutive surface portion which extends towards the lower side of the slab. If with such a design of the slabs it is desired to provide for an additional latching, it is advantageous if the latter is designed such that downwardly extending projections are provided at the front rims of the resting portions, and indentations complementary to these projections are provided on the carrying surfaces of the carrying portions.

Particularly suitable for the course of the levelling procedure during the installation of the slabs and for attaining as stable a position as possible of the two slabs of a slab pair relative to each other in the installed state is an embodiment which is characterized in that the crowned carrying surfaces are shaped like a toothing which allows for a sliding movement or rolling movement of the facing carrying surfaces and resting surfaces one on the other, up to a levelled position of the slabs of the respective slab pair, and which in the levelled position of these slabs locks against a movement of these slabs relative to each other.

Furthermore, there results a geometry favourable for the assembly of the slabs of a slab pair and for the subsequent relative movement of these two slabs during the installation procedure of the slabs, if it is provided for the slabs to be rounded at their facing rims from the plate lower side upwards, the radius of curvature being dimensioned equally to or smaller than the distance between these rims and the rail-side rims of the slabs. For as simple an assembly as possible of the slabs of a slab pair it is advantageous if it is provided for the two slabs of a slab pair to abut each other at the slab lower side approximately along a straight line. If, however, as high a carrying capacity as possible of the slab pair is to be attained, it is suitable if it is provided for the two slabs of a slab pair to abut each other at the slab lower side so as to engage each other in meander-like fashion.

As the material for the slabs in the level cover, in particular concrete, such as cement concrete or polymer concrete or similar composite materials of particulate aggregate and a binder are provided. There, as a rule, it is suitable to arrange a reinforcement in the slabs. A preferred embodiment is characterized in that the slabs are made of concrete or of a concrete-like composite material comprised of a particulate aggregate and a binder and have a reinforcement which extends over the slab area and engages into the carrying portions and resting portions as well as into the at least one rim ledge.

The invention also relates to a rectangular slab for a level cover for tracks designed as discussed before. This slab is characterized in that at the rim side opposite this rim ledge, the slab comprises meander-like successive carrying portions and resting portions, the carrying portions being formed by upwardly directed indentations originating from the slab upper side and extending as far as to the rim, and below the resting portions, indentations originating from the slab lower side being formed and being shaped complementary to the indentations of the carrying portions. Preferably, it is provided that the slab is made of concrete or of a concrete-like composite material comprised of a particulate aggregate and a binder. There, it is furthermore suitable if a reinforcement is provided in the slab, which reinforcement extends over the entire slab area and reaches into the carrying portions and resting portions as well as into the at least one rim ledge.

BRIEF DESCRIPTION OF THE DRAWINGS

The invention will now be described in more detail with reference to examples schematically illustrated in the drawings. In the drawings.

DETAILED DESCRIPTION OF THE INVENTION

Figure 1:
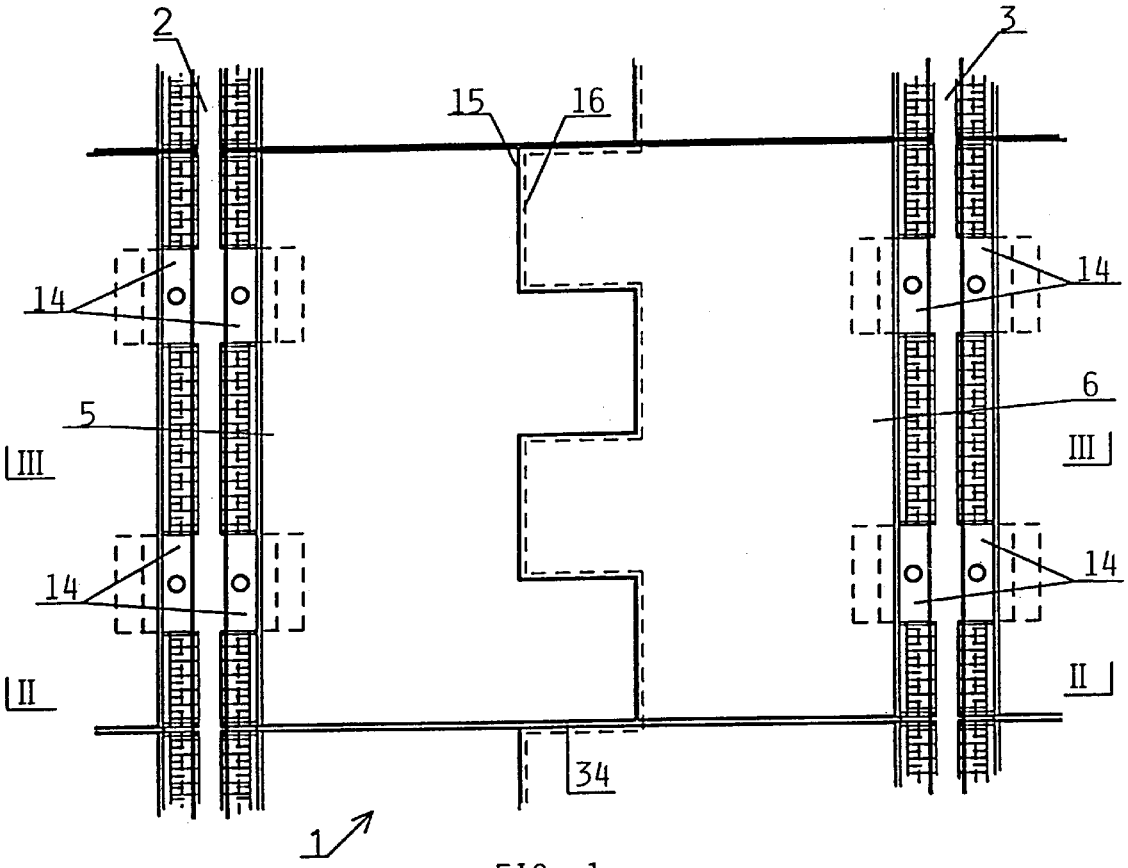
FIG. 1 shows an embodiment of a level cover designed according to the invention, in top view.
Figure 2:
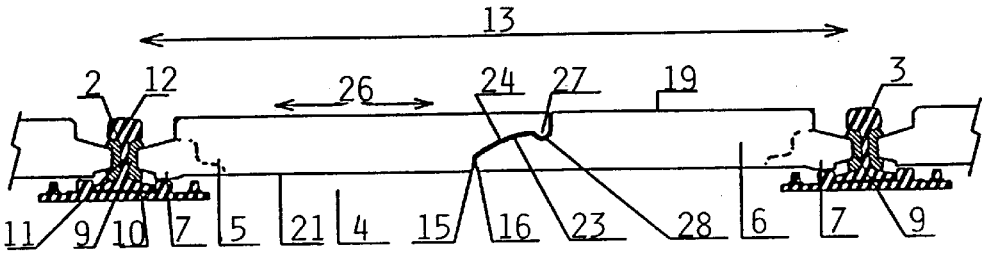
FIG. 2 shows a section of this embodiment according to line II—II of FIG. 1.
Figure 3:
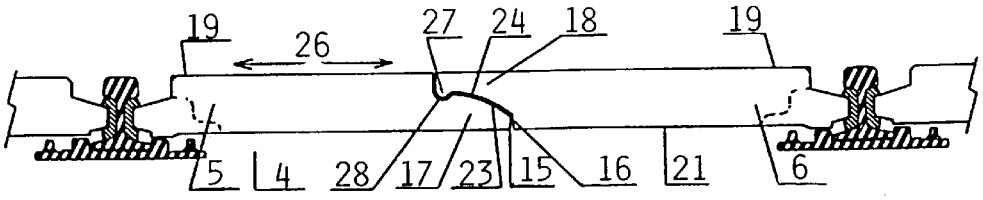
FIG. 3 shows a section of this embodiment according to line III—III of FIG. 1.

In the embodiment of a level cover for tracks designed according to the invention and illustrated in FIGS. 1 to 3, the space 4 present between the two rails 2, 3 of a track 1 is filled or bridged, respectively, by slabs 5, 6 arranged in pairs. These slabs 5, 6 have rim ledges 7 which engage in fishing surfaces 8 of the rails 2, 3, and elastic sections 9 of approximately C-shaped cross-section are inserted between the rim ledges 7 and the rails 2, 3. In this manner, the slabs 5, 6 are supported by their rim ledges 7 on the rail base 10 and, laterally, against the rail web 11, and upwardly they are held by engagement under the rail head 12. The slabs 5, 6 bridge the distance 13 between the rails 2, 3 self-supportingly. On each of the slabs 5, 6, several rim ledges 7 are provided which are arranged in spaced relationship so as to keep the fastening elements 14 provided for the rails 2, 3 accessible. Yet, when choosing different slab dimensions and slab installation arrangements, also only a single rim ledge 7 can be provided on each slab.

Figure 4:
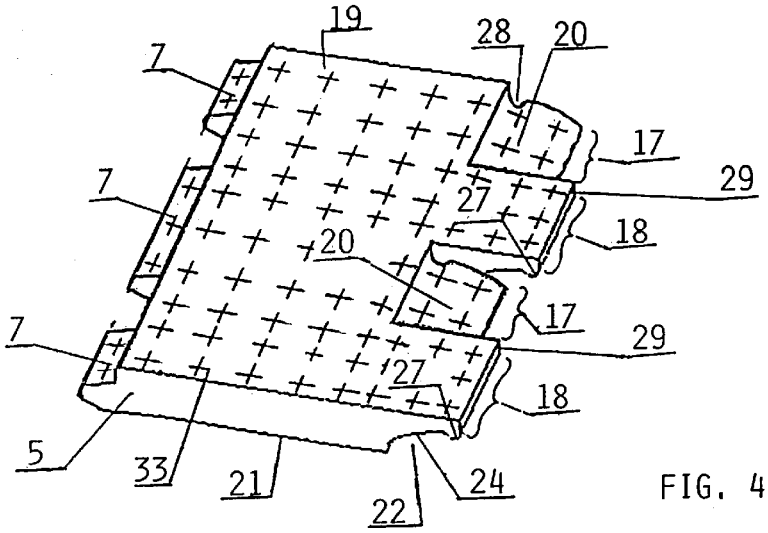
FIG. 4 shows an axonometric view of a slab provided in such cover.

At their facing rims 15, 16, the slabs 5, 6 of each slab pair rest on each other so that each slab pair forms an assembled body that self-supportingly bridges the distance 13 between the rails 2, 3. For this, meander-like alternating consecutive carrying portions 17 and resting portions 18 are provided at each slab 5 or 6, respectively, along the rim facing the other slab 6 or 5, respectively, the carrying portions 17 being formed by indentations 20 departing from the slab upper side 19 and extending as far as to the rim facing the other slab; below the resting portions 18, upwardly directed indentations 22 departing from the slab lower side 21 are formed, and the resting portions of slab 5 rest on the carrying portions of slab 6, and the resting portions of slab 6 rest on the carrying portions of slab 5; the indentations 20 are formed complementary to the indentations 22 so that the resting surfaces 24 formed by the indentations 22 on the resting portions 18 rest with a substantially snug fit on the carrying surfaces 23 formed by the indentations 20 on the carrying portions 17. With respect to the afore-mentioned design of the slabs, reference is also made to the illustration of such a slab in FIG. 4.

Figure 5:
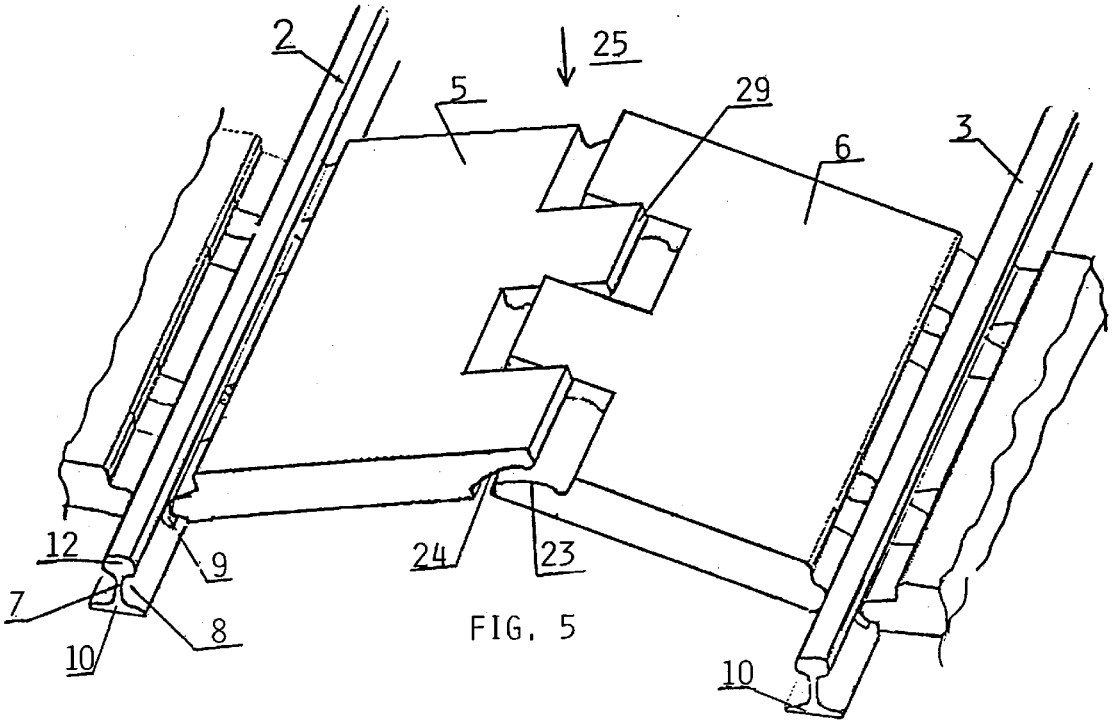
FIG. 5 shows a pair of such slabs in the folded-up state in the course of the insertion procedure, also in an axonometric view.

To insert the slabs 5, 6 in pairs between the rails 2, 3 of a track, at first they can be arranged in the folded-up state, as is illustrated in FIG. 5, and they can be put together with their meander-like designed rims 15, 16, the elastic sections 9 of C-shaped cross-section also being arranged between the rim ledges 7 of the slabs 5, 6 and the rails 2, 3. Subsequently, the slabs 5, 6 are pivoted or swung downwardly as indicated by arrow 25, until they assume the levelled position illustrated in FIGS. 1 to 3 in which the slabs 5, 6 of each slab pair self-supportingly bridge the space 4 between the rails 2, 3.

The carrying surfaces 23 provided in the carrying portions 17 have crowned shape, and such a crowned shape is also provided on the resting surfaces 24 provided on the resting portions 18, and by this crowned shape of the aforementioned surfaces, a positive locking or shape coherence of the slabs 5, 6 is provided which, in the levelled position of the slabs 5, 6, inhibits movement of these slabs relative to each other in the direction of the slab plane (arrow 26). Furthermore, projections 27 are provided on the resting surfaces 24, and indentations 28 shaped complementary to the projections 27 are provided on the carrying surfaces 23; in the levelled position of the slabs, the projections 27 latch into the indentations 28 resulting in a mutual latching of the slabs 5, 6.

If desired, an elastic and/or shock-braking or dampening insert or coating may be provided between the carrying surfaces 23 and the resting surfaces 24.

Originating from the slab lower side 21, the carrying surfaces 23 provided on the carrying portions extend away from the rim 15 or 16 of the respective slab 5 or 6, respectively, and at first rise steeply, and then flatten, which is advantageous for assembling the slabs to slab pairs. From the geometrical standpoint it is suitable if such crowned carrying surfaces are shaped like a toothing which allows for a relative sliding movement or rolling movement of the facing carrying surfaces and resting surfaces one on the other, up to a levelled position of the slabs 5, 6 of the respective slab pair, and which then, in the levelled position (FIGS. 1 to 3), locks these slabs against a movement relative to each other. This surface shape which geometrically corresponds to a toothing may extend as far as to the slab upper side 19.

The projections 27 may be provided at the front rims 29 of the resting portions 18, as is illustrated in FIGS. 1 to 4, as may be advantageous when assembling the slabs; it is, however, also possible to mould such projections 27 at a different location, e.g. at a slight distance from the rim of the resting surfaces.

Figure 6:
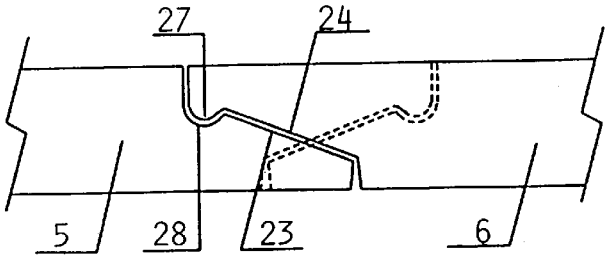
FIG. 6 shows a modification with a view to the design of the carrying portions and the resting portions in a sectional illustration corresponding to that of FIG. 3.

In the modification illustrated in FIG. 6, the carrying surfaces 23 and the resting surfaces 24 are configured to be largely plane; also in this instance, the indentations 28 in which projections 27 engage are provided for a mutual latching of the slabs 5, 6.

Both in the embodiment illustrated in FIGS. 1 to 3 and in the modification illustrated in FIG. 6, the two slabs 5, 6 of a slab pair rest on each other to engage meander-like on the slab lower side 21, so that the facing rims of the slabs 5, 6 extend to follow a meander-like line 34 at the slab lower side. This results in a very intimate positive fit of the slabs 5, 6 which together form a slab pair.

Yet the design of the mutually contacting or engaging portions of the slabs of a slab pair may also be chosen such that the facing rims 15, 16 of the slabs 5, 6 abut each other at the slab lower side 21 along a straight line 30, whereby both the production of the slabs and the course of the assembling procedure can be simplified; such a design is present in the embodiments illustrated in FIGS. 7 to 12. Many details of these embodiments are analogous to those of the embodiments of FIGS. 1 to 6, and therefore reference may be made in this connection to the previous explanations relating to FIGS. 1 to 6. With the embodiment according to FIGS. 7 to 10, the carrying surfaces 23 have a crowned shape, while in the modification according to FIG. 12, these carrying surfaces 23 have a substantially plane configuration. In both instances, projections 27 engaging in indentations 28 are arranged at the front rims of the resting portions. Yet, as has already been mentioned above, such projections 27 may also be placed at different locations in the region of the resting surfaces.

In the embodiments illustrated in FIGS. 7 to 12, the slabs 5, 6 are shaped to be rounded at their facing rims 15, 16 from the plate lower side 21 upwards, the radius of curvature of this rounded portion being dimensioned equally to or smaller than the distance 31 between the rims 15, 16 and the rail-side rims 32 of the slabs 5, 6. Also this measure is advantageous for as unimpeded a course of the insertion procedure of the slabs as possible.

As a rule it is suitable to provide a reinforcement in the slabs. According to a preferred embodiment, the reinforcement 33 extends over the entire area of the slabs 5, 6, engaging, as is indicated in broken lines in FIG. 4, both into the carrying portions 17 and resting portions 18 and into the rim ledges 7.

Figure 7:
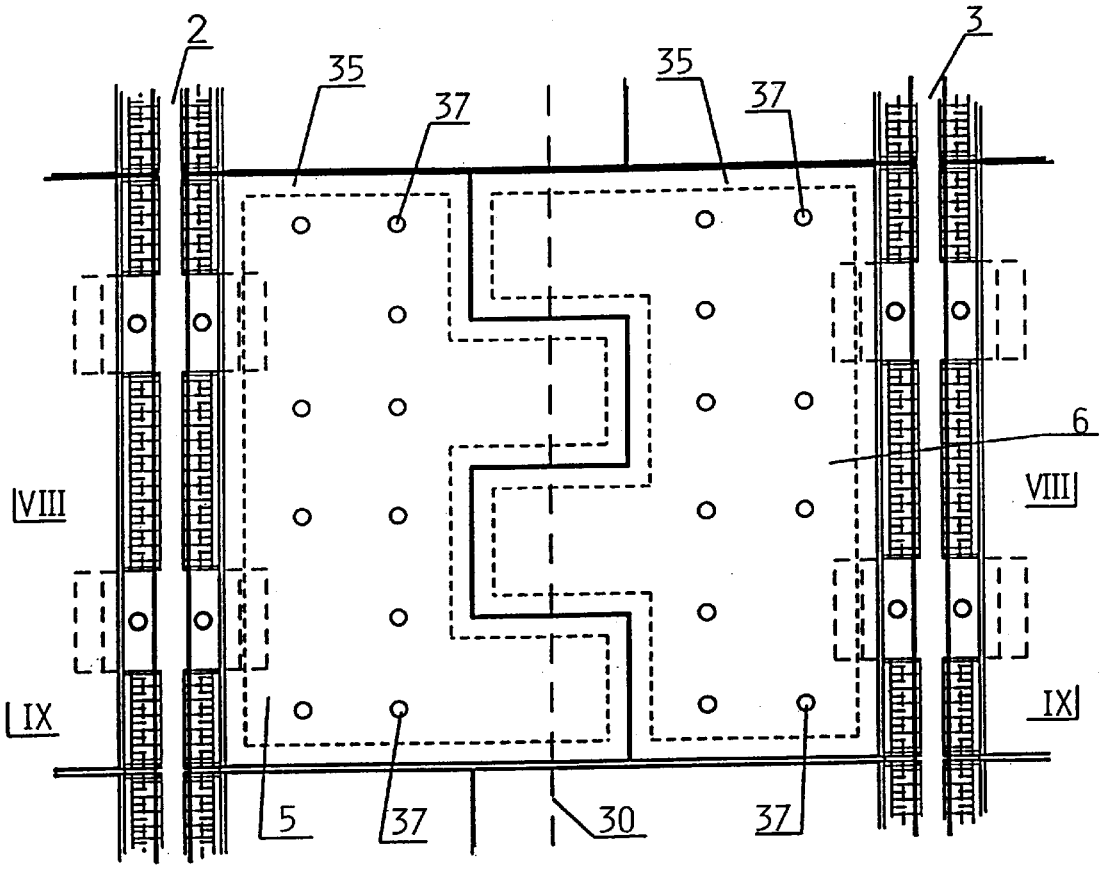
FIG. 7 shows another embodiment of a cover designed according to the invention, in top view.

Furthermore, it is possible to provide the slabs 5, 6 with frames 35, as is, e.g., indicated in broken lines in FIG. 7.

Figure 8:
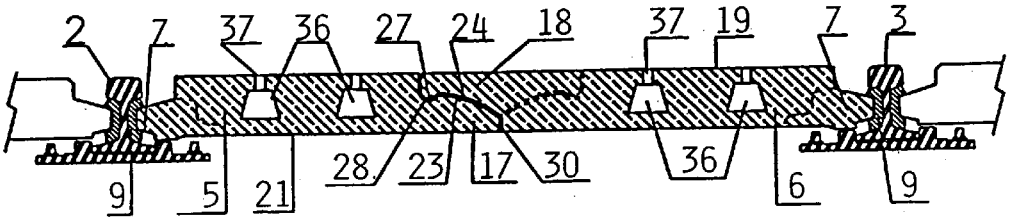
FIG. 8 shows a section of this embodiment according to line VIII—VIII of FIG. 7.
Figure 9:
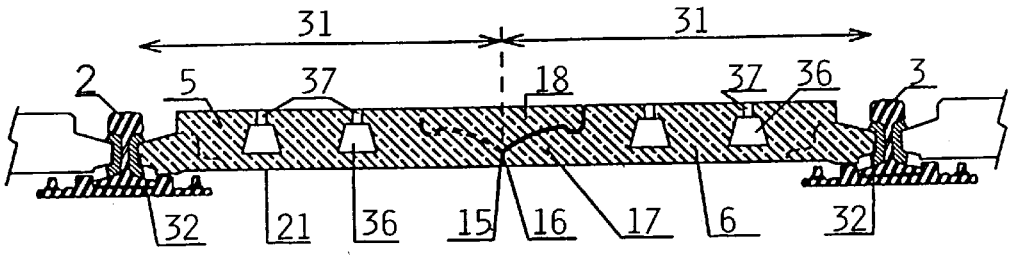
FIG. 9 shows a section of this embodiment according to line IX—IX of FIG. 7.
Figure 10:
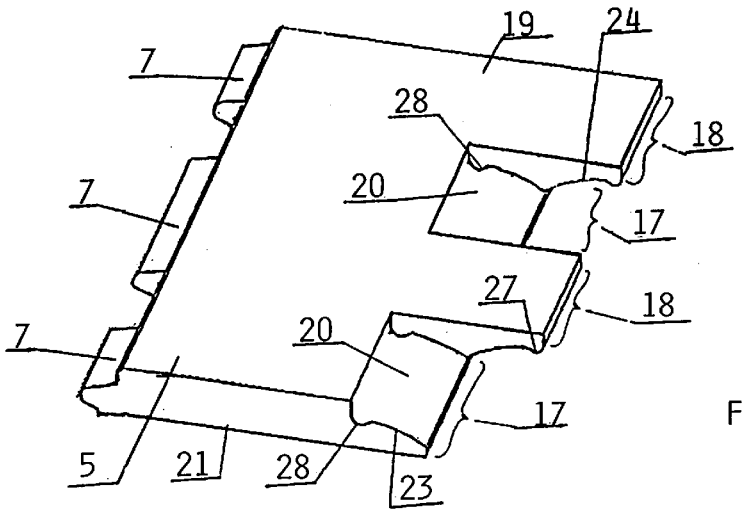
FIG. 10 shows a slab provided in a cover according to FIG. 7, in an axonometric view.
Figure 11:
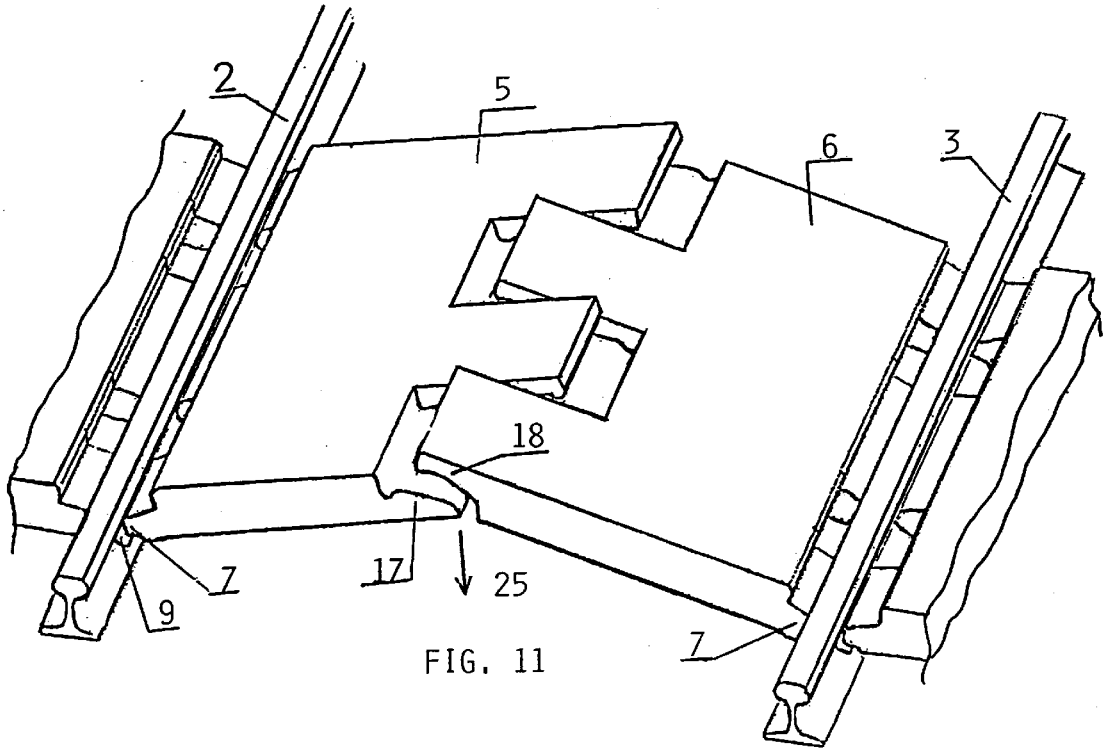
FIG. 11 shows a pair of such slabs in the folded-up state in the course of the insertion procedure, also in axonometric view.
Figure 12:
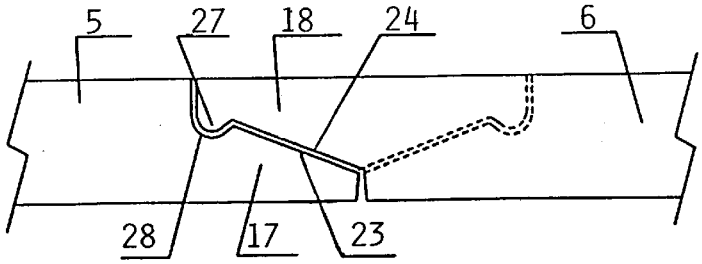
FIG. 12 shows a modification with a view to the design of the carrying portions and the resting portions of the slabs in a sectional illustration corresponding to that of FIG. 9.

From FIGS. 7 to 9 it is furthermore apparent that cavity resonators 36 having sound apertures 37 that end at the slab upper sides may be provided in the slabs 5, 6 for sound absorbing purposes.

What is claimed is:

1. In combination, a railway track having two parallel rails, and a level cover for said track, wherein a space between the two rails is filled or bridged by slabs (5, 6) arranged in pairs which engage by at least one rim ledge (7) in fishing surfaces of the rails and are supported on the rails, bridging the distance between the rails self-supportingly, the two slabs of the slab pairs being assembled in a hinge-like manner and resting on each other at facing rims (15, 16) thereof extending in the longitudinal direction of the track, said rims defining carrying portions (17) and resting portions (18) interleaved with each other in an alternating fashion, the carrying portions being formed by downwardly sloped indentations (20) originating from a slab upper side (19) and extending to the rim facing the other slab, upwardly sloped indentations (22) originating from a slab lower side (21) being formed below the resting portions and shaped complementary to the indentations of the carrying portions, the resting portions of one slab resting on the carrying portions of another, facing slab, and vice versa.

2. The combination according to claim 1, wherein, at those surfaces (23, 24) on which the slabs (5, 6) of one slab pair contact each other, projections (27) and indentations (28) shaped complementary to the projections are formed, the projections latchingly engaging in the indentations for a mutual latching of the slabs (5, 6).

3. The combination according to claim 2, wherein the carrying surfaces (23) provided in the carrying portions (17), originating from the rim facing the other slab of the slab pair, at first rise steeply, starting from the slab lower side (21), and then flatten.

4. The combination according to claim 3, wherein the carrying surfaces (23) provided in the carrying portions (17) have a crowned shape, which shape inhibits a mutual movement of these slabs (5, 6) in a direction of a slab plane (26) in a levelled position of the slabs (5, 6) of the slab pair.

5. The combination according to claim 2, wherein said projections (27) are provided at the front rims (29) of the resting portions (18) and said indentations (28) complementary to said projections (27) are provided on the carrying surfaces (23) of the carrying portions (17).

6. The combination according to claim 4, wherein the crowned carrying surfaces (23) are shaped like a toothing which allows for a sliding movement or rolling movement of the carrying portions and the resting portions one on the other, up to a levelled position of the slabs (5, 6) of the respective slab pair, and which in the levelled position of these slabs locks against a movement of these slabs relative to each other.

7. The combination according to claim 1, wherein the slabs (5, 6) are shaped to be rounded at their facing rims (15, 16) from the said lower side (21) upwards, the radius of curvature being dimensioned equally to or smaller than a distance (31) between these rims (15, 16) and the rim ledges (7) of the slabs (5,6).

8. The combination according to claim 1, wherein the two slabs (5, 6) of a slab pair abut each other at the slab lower side (21) approximately along a straight line (30).

9. The combination according to claim 1, wherein the two slabs (5, 6) of a slab pair abut each other at the slab lower side (21) so as to engage each other in said alternating fashion.

10. The combination according to claim 1, wherein the slabs (5, 6) are comprised of concrete or of a concrete-like composite material of particulate aggregate and a binder and have a reinforcement (33) which extends over the slab area (26) and engages into the carrying portions (17) and resting portions (18) as well as into the at least one rim ledge (7).

11. The combination according to claim 1, wherein an elastic and/or shock-dampening insert or coating is provided between carrying surfaces (23) provided on the carrying portions and resting surfaces (24) provided on the resting portions.

* * * * *